United States Patent [19]

Glass

[11] 4,298,186

[45] Nov. 3, 1981

[54] HOLLOW PLASTIC BARRICADE

[76] Inventor: Geoffrey M. Glass, 21 Bridlewood Rd., Northbrook, Ill. 60062

[21] Appl. No.: 152,039

[22] Filed: May 21, 1980

[51] Int. Cl.[3] ..... E04H 17/14

[52] U.S. Cl. ..... 256/64; 404/6; 40/606

[58] Field of Search ..... 404/6, 9; 256/64, 65; 40/606, 612

[56] References Cited

U.S. PATENT DOCUMENTS

| | | | |
|---|---|---|---|
| 3,627,273 | 12/1971 | Birner | 256/64 |
| 3,802,667 | 4/1974 | Kanan | 256/64 |
| 3,880,406 | 4/1975 | Stehle | 256/64 |
| 3,917,232 | 11/1975 | Lindner | 404/6 X |
| 3,950,873 | 4/1976 | Stehle | 256/64 X |
| 4,104,980 | 8/1978 | Toomey | 256/64 X |
| 4,253,777 | 3/1981 | Pillifant | 256/64 X |

*Primary Examiner*—Nile C. Byers, Jr.
*Attorney, Agent, or Firm*—Thomas R. Vigil

[57] ABSTRACT

The hollow plastic barricade comprises a pair of identical, integral, hollow, hinged-together barricade frame members, each frame member having first and second hinge sections located at respective upper corners thereof. The first hinge section on one frame member cooperates with the second hinge section on the other frame member to form two hinges between the frame members. Each frame member comprises two hollow, spaced apart side frame portions with a leg at the bottom of each side portion, an upper hollow panel, a middle hollow panel and a lower hollow sandbag bar, all extending between the side frame portions. The middle panel is spaced beneath the upper panel and the hollow sandbag bar is spaced beneath the middle panel and is spaced above the bottom of the legs a distance which will permit the barricade to be placed over uneven terrain and still be supported by the legs. At least one of the panels is adapted to receive indicia thereon. The first and second hinge sections each include at least one arcuately extending hook-like projection with a bore extending transversely through the sides thereof and with an end surface adapted to engage and bear against a top edge of the other frame member. Each frame member has an opening for placing particulate ballast material, such as sand, in the frame member, and the barricade further comprises two pins each of which is received through a pair of adjacent projections extending from respective ones of the frame members.

21 Claims, 9 Drawing Figures

EXPERIMENTAL MODEL

EXPERIMENTAL MODEL

EXPERIMENTAL MODEL

FIG. 7
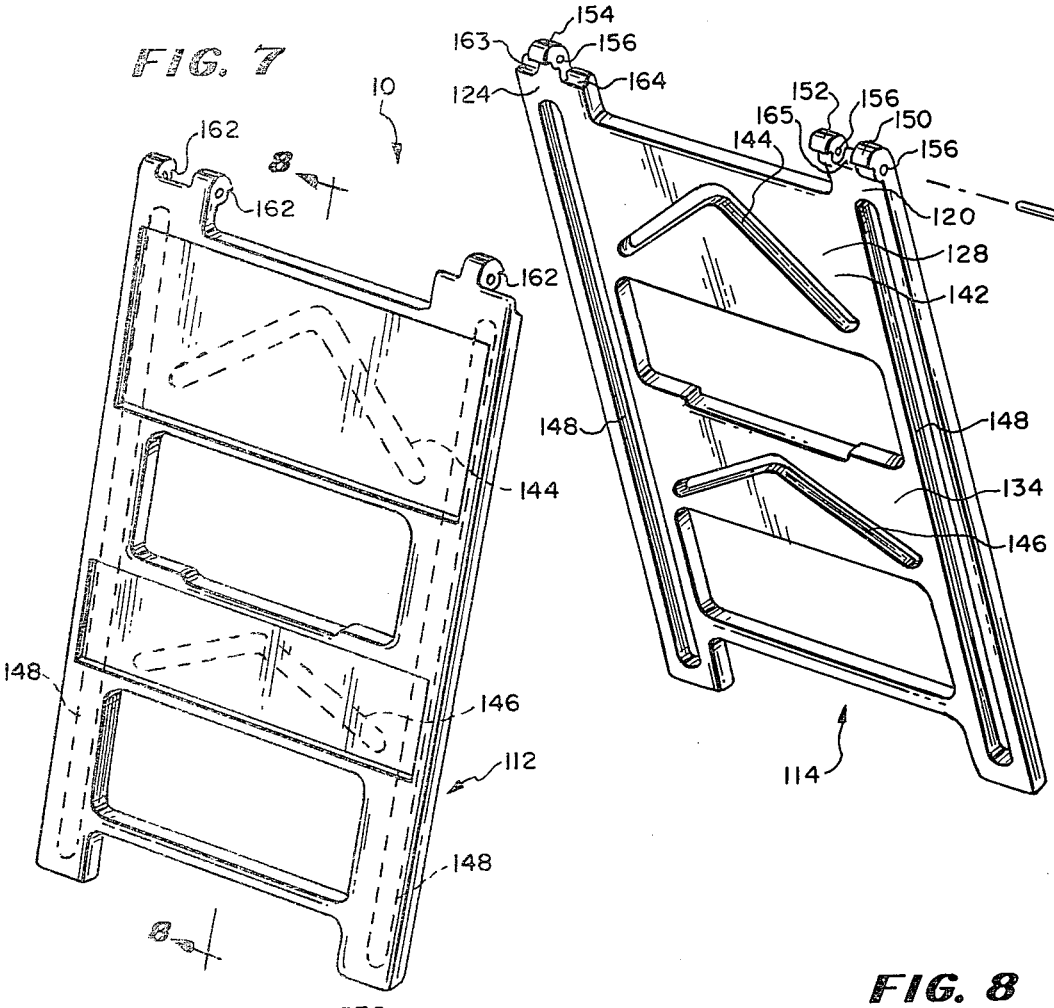
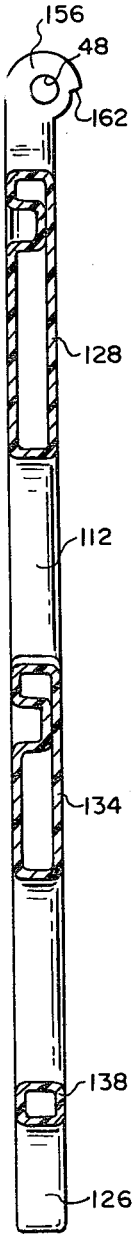
FIG. 8
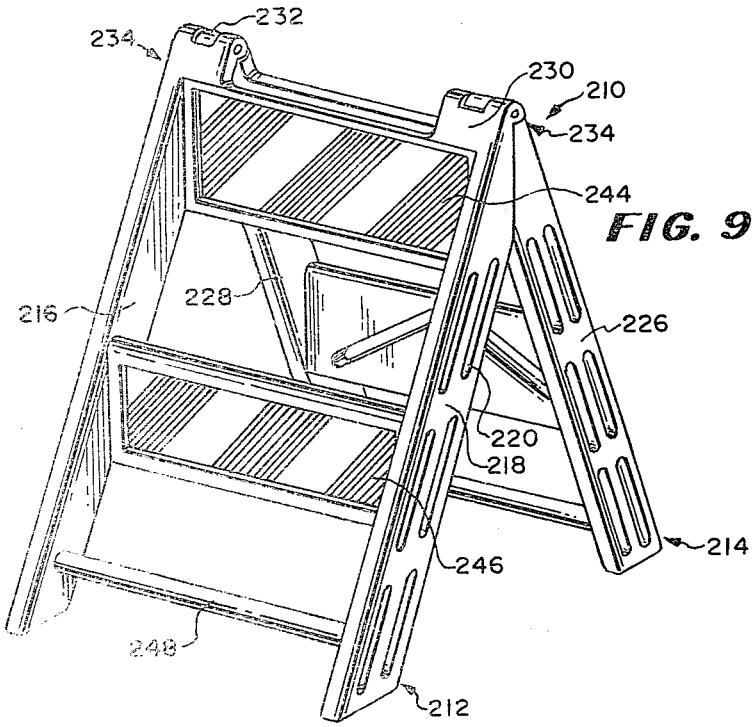
FIG. 9

HOLLOW PLASTIC BARRICADE

BACKGROUND OF THE INVENTION

1. Field of the Invention

The present invention relates to plastic barricades.

2. Description of the Prior Art

Heretofore a hollow plastic traffic barricade has been proposed as well as a hollow plastic support post for forming a barricade structure. Examples of such previously proposed plastic barricades and plastic support posts for barricade structures are disclosed in the following U.S. Patents:

| U.S. PAT. NO. | PATENTEE |
|---|---|
| 3,880,406 | Stehle et al. |
| 3,950,873 | Stehle et al. |

In U.S. Pat. No. 3,880,406, there is disclosed a hollow plastic barricade which is made of first and second hollow plastic panel members each having hollow legs and each having a middle panel spaced above the bottom of the hollow legs. One panel has an upper panel portion extending angularly therefrom with respect to the middle panel such that the upper panel portion will extend generally vertically at the top of the plastic barricade when the first and second panel members are spread apart about hinges connecting the panel members together thereby to form the plastic barricade.

In use, the hollow plastic barricade is filled with a particulate ballast material, such as sand, at least half way up to give it ballast. In this way, when the plastic barricade is struck by a vehicle, it will collapse and fall under the vehicle resulting in no damage to the vehicle whereby the plastic barricade meets Federal Highway Administration standards which require that barricade devices not inflict any severe damage to a vehicle or to the occupants thereof when it is inadvertently stricken by a vehicle.

Plastic barricades of the type disclosed in U.S. Patent 3,880,406 have proved very satisfactory except for the habits of highway constructions workers, who, notwithstanding the provision of a hollow barricadd which can be and is filled with sand, still continue to place sandbags over the middle panel. Such sandbags have caused the plastic barricade to sag and collapse and not fulfill its function.

As will be described in greater detail hereinafter, an experimental new plastic barricade was developed to overcome this deficiency. Such experimental model included identical frame members each including side frame portions, an upper panel, an intermediate panel spaced below the upper panel and a sandbag support bar all extending between the side frame portions. The two frame members were hinged together with a hinge arrangement much like that found on a clothespin and the sandbag support bar was located adjacent the bottom of two legs formed, respectively, at the lower end of each side frame portion. This experimental model of a plastic barricade after a period of trial uses encountered many failures because workmen continued to place sandbags over the middle panel and this caused sagging. More importantly, however, the clothespin type hinges at the top of each frame member and interconnecting the frame members did not have sufficient strength and cracked apart when the abutting surfaces of the hinge sections bore against each other and placed shear forces on the hinge pins. Also, the position of the sandbag support bar was too close to the ground and did not permit the plastic barricade to be positioned over uneven terrain such as rocks or over a curb.

As will be described in greater detail hereinafter, the plastic barricade of the present invention provides two strong hinges wherein the bearing forces between the opposed sections of the hinge are located in planes substantially non-perpendicular to the frame members such that very few failures of the hinges are incurred. Also, the plastic barricade of the present invention provides a lower sandbag support bar which is spaced a sufficient distance above the bottom of the legs of the plastic barricade to permit the barricade to be supported by the legs on uneven terrain with a sandbag placed over the bar. Other improved features of the plastic barricade of the present invention are described in greater detail hereinafter.

SUMMARY OF THE INVENTION

According to the invention there is provided a hollow plastic barricade comprising a pair of identical, integral, hollow, hinged-together barricade frame members, each frame member having first and second hinge sections located at respective upper corners thereof with said first hinge section on one frame member cooperating with said second hinge section on the other frame member to form two hinges between said frame members, each frame member comprising two hollow, spaced apart side frame portions with a leg at the bottom of each side portion, an upper hollow panel, a middle hollow panel and a lower hollow sandbag bar, all extending between said side frame portions, said middle panel being spaced beneath said upper panel and said hollow sandbag bar being spaced below said middle panel and being spaced above the bottom of said legs a distance which will permit the barricade to be placed over uneven terrain and still be supported by said legs, at least one of said panels being adapted to receive indicia thereon, said first and second hinge sections each including at least one arcuately extending hook-like projection with a bore extending transversely through the sides thereof and with an end surface adapted to engage and bear against a top edge of the other frame member, each frame member having an opening for placing particulate ballast material, such as sand, in said frame member, and said barricade further comprising two pins each of which is received through a pair of adjacent projections extending from respective ones of said frame members.

BRIEF DESCRIPTION OF THE DRAWINGS

FIG. 7 is an exploded perspective view of the plastic barricade shown in FIG. 4 with pins removed from hinge sections forming the hinges.

FIG. 8 is a generally vertical sectional view of one frame member of the plastic barricade and is taken along line 8—8 of FIG. 7.

FIG. 9 is a perspective view of another embodiment of the plastic barricade of the present invention.

DESCRIPTION OF THE PREFERRED EMBODIMENT(S)

Figure 1:
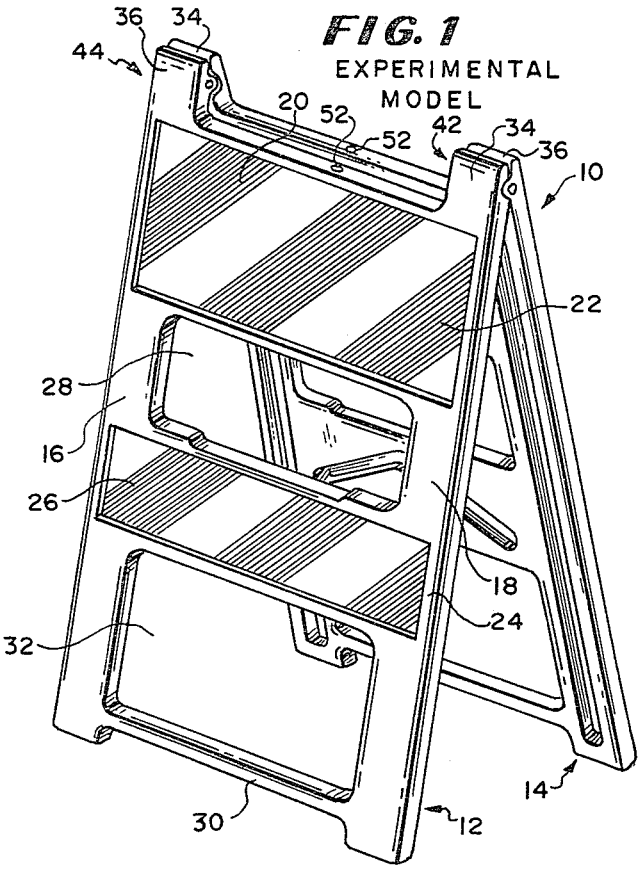
FIG. 1 is a perspective view of an experimental model of a plastic barricade which preceeded the plastic barricade of the present invention.

Referring now to the drawings in greater detail there is illustrated in FIG. 1 an experimental model of an improved plastic barricade generally identified by the reference numeral 10. The plastic barricade 10 includes a pair of identical, hollow frame members 12 and 14. Since the hollow frame members 12 and 14 are essentially identical, only one of them, the frame member 12, will be described in detail.

As shown in FIG. 1, the frame member 12 comprises two parallel spaced side frame portions 16 and 18. An upper panel 20 with warning indicia 22 thereon extends between the two side frame portions 16 and 18. Likewise a middle panel 24 with warning indicia 26 thereon extends between the two side frame portions 16 and 18 and is spaced from the upper panel 20 by a generally rectangular open space 28 in the frame member 12. A hollow sandbag support bar 30 extends between the side frame portions 16 and 18 adjacent the bottom of the frame member 12 and is spaced from the middle panel 24 by a generally rectangular open space 32.

At the upper end of the frame member 12 is a first hinge section 34 and a second hinge section 36. The first hinge section 34 on the frame member 12 is adapted to connect with a second hinge section 26 on the other frame member 14. Likewise the second hinge section 36 on the frame member 12 is adapted to connect with a first hinge section 34 on the other frame member 14. The mating, cooperating first and second hinge sections 24 and 36 form hinges 42 and 44.

Figure 2:
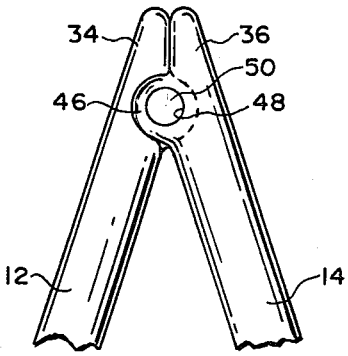
FIG. 2 is a fragmentary side elevational view of one hinge of the experimental model of the barricade shown in FIG. 1 with the frame members of the barricade spread apart.

As shown in FIG. 2, the upper ends of the first and second hinge sections 24 and 36 on the facing sides thereof are tapered so that when the frame members 12 and 14 are folded outwardly about the hinges 42 and 44, the tapered surfaces engage each other in a generally vertical plane.

Figure 3:
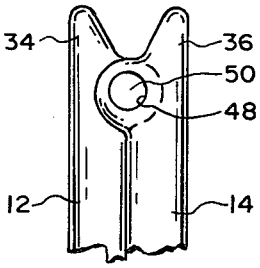
FIG. 3 is a fragmentary side elevational view of the hinge shown in FIG. 2 but with the frame members moved to a face-to-face position.

As best shown in FIGS. 2 and 3, each of the hinge sections 34 and 36 has two or three laterally spaced projections 46 each of which has a bore 48 therethrough in which is received a pin 50.

As shown in FIG. 1, each of the frame members 12 and 14 has at least one opening 52 therein in a top edge thereof whereby particulate ballast material, such as sand, can be introduced into the frame members 12 and 14.

In use, the members 12 and 14 are filled with sand at least half way up from the bottom and folded outwardly as shown in FIGS. 1 and 3 so that the barricade 10 can be set up in place along the side of a highway. Typically, construction workers will hang a sandbag over the middle panel 24, such sandbag extending through the open space 28. Ideally, of course, the sandbag will be placed over the sandbag supporting bar 30. This does not always happen, however.

In any event, with a plastic barricade 10 set up as shown in FIG. 1 and with the sandbag being hung over the middle panel 24, forces are exerted on the hinge which have caused the hinge to fail. These forces have been essentially shearing forces on the pin 50, which, being made of plastic material, has failed.

Also, the low position of the sandbag support bar 30 has prevented the plastic barricade 10 from being used over uneven terrain or from staddling a curb. In any event, after a number of trial uses of the experimental uses of the experimental model of the plastic barricade 10 shown in FIGS. 1, 2 and 3, it was found that this barricade 10 did not satisfactorily meet the requirements for strength and positionability required of barricades.

Figure 4:
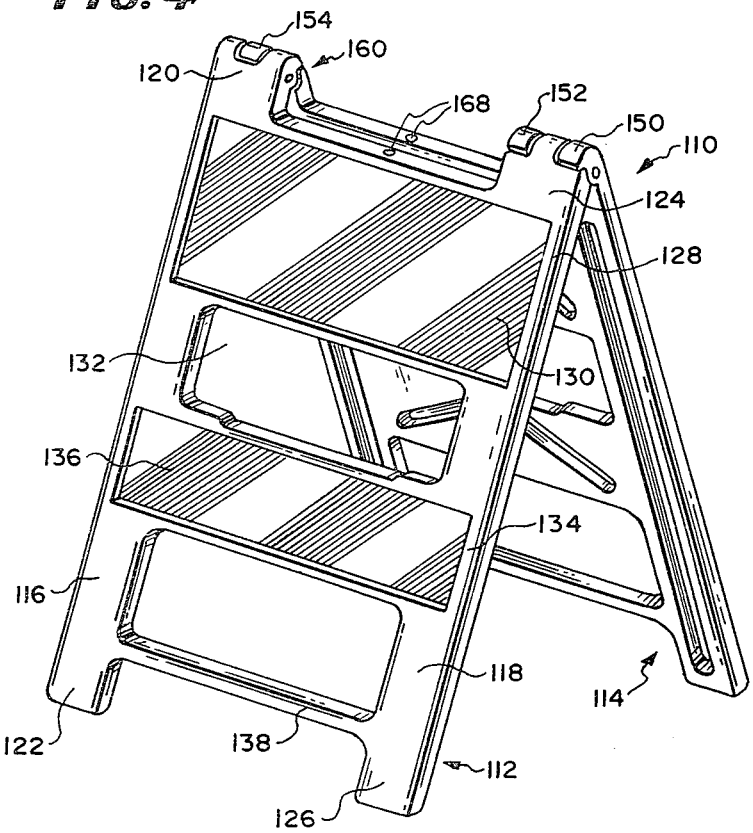
FIG. 4 is an exploded view of one embodiment of the plastic barricade of the present invention.

As a result, and in accordance with the teachings of the present invention, a plastic barricade was constructed as shown in FIG. 4, which barricade is generally identified by reference numeral 110. Again, the plastic barricade 110 is made of two identical, integral hollow frame members 112 and 114, only one of which, the frame member 112, will be described in detail.

As shown, the frame member 112 has two generally spaced apart hollow tubular side frame portions 116 and 118. The side frame portion 116 has a first hinge section 120 at the top thereof and a bottom leg 122 at the bottom thereof. Likewise the side frame portion 116 has a second hinge section 124 at the top thereof and a bottom leg 126 at the bottom thereof.

An upper panel 128 with indicia 130 thereon extends between the side frame portions 116 and 118 and is separated by a generally rectangular space 132 from a middle panel 134 with indicia 136 thereon which also extends between the side frame portions 116 and 118. A hollow sandbag support bar 138 extends between the frame portions 116 and 118 above the bottoms of the bottom legs 122 and 126 and is separated by a rectangular space 140 from the middle panel member 134.

According to the teachings of the present invention, the hollow sandbag support bar 138 is spaced at least three inches (7.62 cm) above the bottom legs 122 and 126 and can extend up to five inches (12.7 cm) above the bottom of the bottom legs 122 and 126 thereby to provide sufficient space for positioning the plastic barricade 10 on uneven terrain or for straddling a curb.

As best shown in FIG. 7, the upper panel 128 on the inner side surface 142 thereof has a depression 144 therein extending in a V to form a V-shaped reinforcing rib. Likewise the middle panel 134 has a depression 146 therein extending in a V to form a V shaped reinforcing rib therein. Additionally, each of the tubular side frame portions 116 and 118 has an elongate depression 148 therein to form an elongate reinforcing rib therein.

The first hinge section 120 at the upper end of the tubular side frame portion 116 has two spaced apart hook-like projections 150, 152 extending therefrom and the second hinge section 124 has a single hook-like projection 154 extending therefrom. Each of the hook-like projections 150, 152, and 154 have bores 156 extending through the sides thereof and, as shown in FIGS. 4, 5, 6, and 7, the single projection 154 of a second hinge section 124 one one frame member 112 is received between the spaced apart projections 150, 152 of a first hinge section 120 on the other frame member 114, and a pin 158 (FIG. 7) made of a thermoplastic material, such as that sold under the trademark Delrin by DuPont Products, is received through the aligned bores in the projections 150, 152 and 154 to form complete hinges 160 between the barricade frame members 112 and 114.

Figure 5:
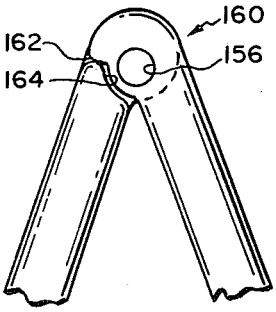
FIG. 5 is a fragmentary side elevational view of one hinge of the plastic barricade shown in FIG. 4 with the frame members of the barricade spaced apart.
Figure 6:
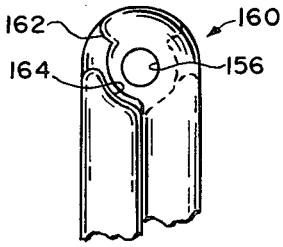
FIG. 6 is a fragmentary side elevational view of the hinge shown in FIG. 5 but with the frame members of the barricade moved to a face-to-face position.

As best shown in FIGS. 5 and 6, the outer end of each one of the projections has a surface 162 which engages a top edge surface 163, 164 or 165 of the respective hinge section 120 or 124 at the top of the respective frame member 112 or 114. In this way, bearing vector forces between the hinge sections 120 and 124 will be generally non-transverse to the plane of the frame member 112 or 114 and rather will be close to or in the plane of the frame member 112 o4 114.

As shown in FIG. 4, each frame member 112, 114 has one or more openings 168 in the top thereof whereby particulate ballast material, such as sand, can be inserted into the frame member 112, 114. Preferably, each frame member 112 or 114 is only half filled with sand to provide the desired ballast.

According to the teachings of the present invention, each frame member 112, 114 is made by rotational molding techniques or by blowmolding techniques and preferably is made of polyethylene.

Another embodiment of a plastic barricade made in accordance with the teachings of the present invention is illustrated in FIG. 9 and identified therein by reference numeral 210. This plastic barricade 210 includes two hollow frame members 212 and 214 which can be identical if desired or with mating configurations as shown in FIG. 9. The frame member 212 has two plank-shaped spaced-apart side frame portions 216 and 218 which are parallel spaced from each other and which lie in respective separate planes parallel spaced from each other. These side frame portions 216 and 218 have the general shape of the sides of a ladder and are configured to provide greater support for the plastic barricade 210. As shown, each of these side frame portions 216, 218 has six short elongate depressions 220 therein forming six reinforcing ribs. The frame member 214, likewise, has two similar plank-shaped, spaced apart side frame portions 226 and 228.

The frame member 212 has a pair of spaced apart first hinge sections 230 and the frame member 214 has a pair of mating second hinge sections 232 at the top thereof with the first hinge sections 230 mating with the second hinge sections 232 to form hinges 234 at each upper corner of the plastic barricade 210. These hinges 234 are similar to the hinges 160 shown in FIG. 4 and therefore will not be described in greater detail.

Like the barricade 110 shown in FIG. 4, each of the frame member 212 and 214 of the barricade 210 shown in FIG. 9 has an upper panel 244, a middle panel 246 and a sandbag support bar 248 extending between the side frame portions 216 and 218 or 226 and 228. As shown, however, the upper panel 244 and middle panel 246 lie in planes which intersect the elongate axes of the side frame portions 216 and 218 so that in the erect position shown in FIG. 9, the upper panel 244 and middle panel 246 will extend in generally vertical planes and thereby be more resistant to bending or collapsing under the weight of a sandbag which may be placed thereupon.

The plastic barricades 110 and 210 made according to the teachings of the present invention provide a strong barricade on which sandbags can be placed over the middle panels 134, 246 thereof or over the sandbag support bars 138,248 thereof. Also, the hinges 120, 124 or 234 are strong enough to withstand the forces applied to the barricade 110 or 210 by sandbags placed thereon and the bottom sandbag support bar 138 or 248 of each frame member of each barricade 110 or 210 is located sufficiently above the ground so that the barricade can be placed over uneven terrain.

The plastic barricades 110 and 210 of the present invention have a number of advantages, some of which have been described above and others of which are inherent in the invention. Also, of course, obvious modifications can be made to the plastic barricades 110 and 210 without departing from the teachings of the invention. Accordingly, the scope of the invention is only to be limited as necessitated by the accompanying claims.

I claim:

1. A hollow plastic barricade comprising a pair of identical, integral, hollow, hinged-together barricade frame members, each frame member having first and second hinge sections located at respective upper corners thereof with said first hinge section on one frame member cooperating with said second hinge section on the other frame member to form two hinges between said frame members, each frame member comprising two hollow, spaced apart side frame portions with a leg at the bottom of each side portion, an upper hollow panel, a middle hollow panel and a lower hollow sandbag bar, all extending between said side frame portions, said middle panel being spaced beneath said upper panel and said hollow sandbag bar being spaced beneath said middle panel and being spaced above the bottom of said legs a distance which will permit the barricade to be placed over uneven terrain and still be supported by said legs, at least one of said panels being adapted to receive indicia thereon, said first and second hinge sections each including at least one arcuately extending hook-like projection with a bore extending transversely through the sides thereof and with an end surface adapted to engage and bear against a top edge of the other frame member, each frame member having an opening for placing particulate ballast material, such as sand, in said frame member, and said barricade further comprising two pins each of which is received through a pair of adjacent projections extending from respective ones of said frame members.

2. The hollow plastic barricade according to claim 1 wherein said hinges are configured so that end surfaces of said projections and said engaged top edges of said frame members form cooperating stop means with the bearing force vectors therebetween lying generally in a plane substantially non-perpendicular to each of said respective frame members.

3. The hollow plastic barricade according to claim 2 wherein said plane containing said force vectors is close to the plane of said frame member having the top edge which is engaged by said end surface.

4. The hollow plastic barricade according to claim 1 wherein each of said projections has a predetermined arcuate length which permits said frame members to be folded outwardly about said hinges from a flat face-to-face position to a predetermined open position forming a predetermined arc between the folded-out frame members.

5. The hollow plastic barricade according to claim 1 wherein each said first hinge section comprises two of said projections which are laterally spaced apart and each of said second hinge sections comprises only one of said projections which is located on said frame member so as to be received between said two projections of said first hinge section of the other frame member.

6. The hollow plastic barricade according to claim 1 wherein said frame members are made of polyethylene.

7. The hollow plastic barricade according to claim 1 wherein said pins are made of a thermoplastic material.

8. The hollow plastic barricade according to claim 1 wherein said frame members are made by rotational molding techniques.

9. The hollow plastic barricade according to claim 1 wherein said frame members are made by blowmolding techniques.

10. The hollow plastic barricade according to claim 1 wherein said side frame portions have a generally tubular configuration.

11. The hollow plastic barricade according to claim 10 wherein each said tubular side frame portion has at least one elongate depression therein forming a reinforcing rib.

12. The hollow plastic barricade according to claim 10 wherein said upper panel and said middle panel are generally coplanar with each other and with elongate axes of said tubular side frame portions.

13. The hollow plastic barricade according to claim 11 wherein said middle panel has a depression therein extending in a V and forming a V shaped reinforcing rib.

14. The hollow plastic barricade according to claim 11 wherein said upper panel has a depression therein extending in a V to form a V shaped reinforcing rib.

15. The hollow plastic barricade according to claim 1 wherein said distance between the bottom of said legs and the hollow sandbag bar is approximately between 3 and 5 inches (7.62 to 12.7 cm).

16. The hollow plastic barricade according to claim 15 wherein said distance is approximately 3 inches (7.62 cm).

17. The hollow plastic barricade according to claim 1 wherein each each side frame portion has a generally plank shape, said plank-shaped side frame portions being arranged such that planes containing the respective plank-shaped side frame portions are parallel spaced from each other, the planes of said panels being perpendicular to the plane of said side plank-shaped side frame portions.

18. The hollow plastic barricade according to claim 17 wherein said middle panel lies in a plane which is transverse to the elongate axis of each of said side frame portions whereby when said frame members are folded out about said hinges and supported on level terrain, said middle panel of each frame member lies in a generally vertical plane.

19. The hollow plastic barricade according to claim 17 wherein each of said plank-shaped frame portions has one or more elongate depressions therein each extending parallel to the elongate axis of said plank-shaped frame portion thereby to form a reinforcing rib in said plank-shaped side frame portion.

20. The hollow plastic barricade according to claim 17 wherein said middle panel has a depression therein extending in a V to form a V-shaped reinforcing rib.

21. The hollow plastic barricade according to claim 17 wherein said upper panel lies in a plane which is transverse to the elongate axis of each of said side frame portions whereby when said frame members are folded out about said hinges and supported on level terrain, said upper panel of each frame member lies in a generally vertical plane.

* * * * *